US005292082A

United States Patent [19]

Genevray

[11] Patent Number: 5,292,082

[45] Date of Patent: Mar. 8, 1994

[54] DEVICE FOR DRIVING THE BOBBIN OF A BANK OF SPINDLES FOR LONG AND SHORT FIBERS

[75] Inventor: Henri Genevray, Guebwiller, France

[73] Assignee: N. Schlumberger et Cie, S.A., Guebwiller, France

[21] Appl. No.: 31,917

[22] Filed: Mar. 16, 1993

Related U.S. Application Data

[63] Continuation of Ser. No. 878,306, May 4, 1992, abandoned.

[30] Foreign Application Priority Data

May 6, 1991 [FR] France ..... 91 05727

[51] Int. Cl.[5] ..... B65H 54/54; B65H 75/30

[52] U.S. Cl. ..... 242/46.21; 242/46.6

[58] Field of Search ..... 242/46.21, 46.2, 46.3, 242/46.5, 46.6; 57/129, 130

[56] References Cited

U.S. PATENT DOCUMENTS

| | | | |
|---|---|---|---|
| 942,777 | 12/1909 | Cunniff | 242/46.6 |
| 2,417,525 | 3/1947 | Smith | 242/46.2 X |
| 2,773,346 | 12/1956 | Childs et al. | 242/46.2 |
| 3,529,784 | 9/1970 | L'Allemand | 242/46.21 |
| 3,534,917 | 10/1970 | Blake | 242/46.21 |
| 3,544,026 | 12/1970 | Bowie et al. | 242/46.6 |
| 4,428,541 | 1/1984 | Novak | 242/46.2 |

FOREIGN PATENT DOCUMENTS

| | | | |
|---|---|---|---|
| 0392338 | 10/1990 | European Pat. Off. . | |
| 763507 | 2/1934 | France | 242/46.6 |
| 1503330 | 10/1967 | France | 242/46.21 |
| 2415154 | 8/1979 | France . | |

*Primary Examiner*—Stanley N. Gilreath
*Attorney, Agent, or Firm*—Young & Thompson

[57] ABSTRACT

The combination of a rotatable spindle and a bobbin receivable on the spindle for winding fibers on the bobbin. The spindle has an upper free end, and on this upper free end there is an elastically deformable drive for the bobbin, comprising a circular array of spaced resilient spring leaves. The bobbin is hollow and has on its interior a correspondingly spaced series of recesses that receive the spring leaves so that rotation of the spindle is transmitted to the bobbin via the spring leaves and recesses. The spring leaves are secured to the spindle at their lower ends and extend upwardly and radially outwardly from their lower ends and terminate in free ends that extend upwardly and radially inwardly relative to the axis of rotation of the spindle.

1 Claim, 2 Drawing Sheets

DEVICE FOR DRIVING THE BOBBIN OF A BANK OF SPINDLES FOR LONG AND SHORT FIBERS

This application is a continuation of application Ser. No. 07/878,306, filed May 4, 1992, now abandoned.

The present invention relates to the field of the textile industry, particularly the banks of spindles for long and short fibers, especially the drive of the bobbins of such banks of spindles, and has for its object a driving device adapted for this purpose.

At present, the driving in rotation of the bobbins of banks of spindles is generally effected by means of a nose disposed at the base of the spindle and coacting with a recess provided in the base of the bobbin. The nose which coacts with said recess thus drives the bobbin. However, to effect such a drive it is necessary that the operator bring the recess of the bobbin into coaction with the nose of the spindle.

Such an operation is possible so long as lifting is effected manually, the operator himself emplacing the bobbins, but in the case of an automatic lifting, the bobbin can be brought into any angular position relative to the spindle, such that it is less possible that the recess of the bobbin will be located just above the nose of the spindle, which can have as a result defective drive of the bobbin, namely particularly a sliding on the nose until the securement of this latter in the recess, said securement then effecting an abrupt acceleration which is damaging to the yarn.

The present invention has for its object to overcome these drawbacks.

It thus has for its object a drive device of the bobbin of a bank of spindles for long and short fibers characterized in that the spindle has at its upper free end an elastically deformable drive means coacting shape-matingly with a corresponding arrangement in the internal upper portion of the bobbin.

The invention will be better understood from the following description, which refers to a preferred embodiment, given by way of non-limiting example, and explained with reference to the accompanying schematic drawings, in which.

Figure 1:
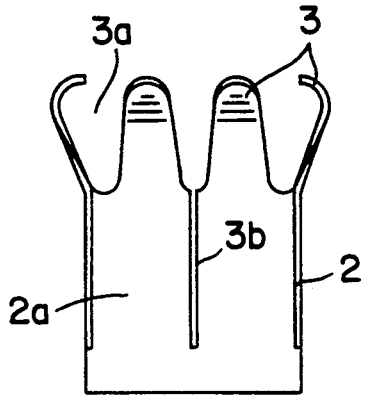
FIG. 1 is an elevational view of the bobbin drive device according to the invention.
Figure 2:
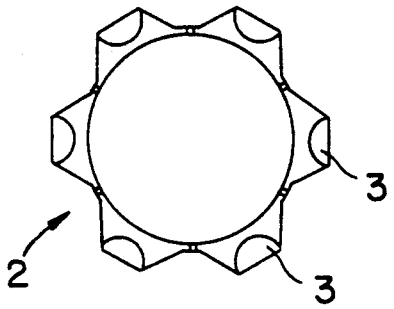
FIG. 2 is a top plan view of the device according to FIG. 1.
Figure 3:
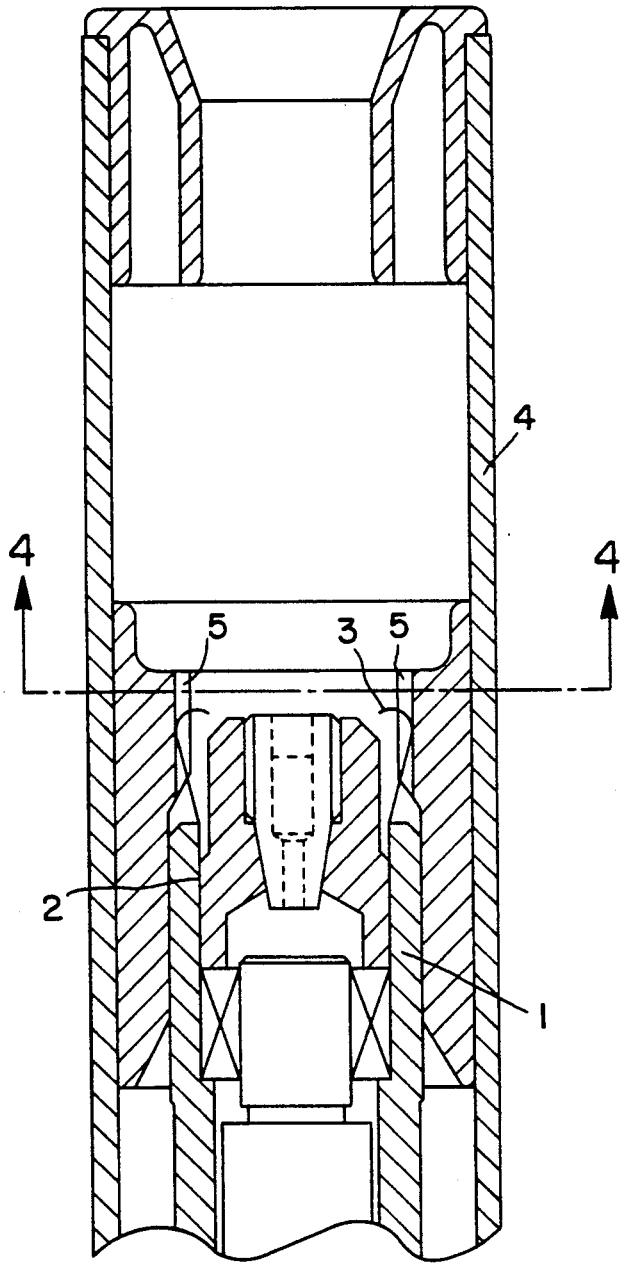
FIG. 3 is a fragmentary longitudinal cross-sectional view showing the combination of the present invention.
Figure 4:
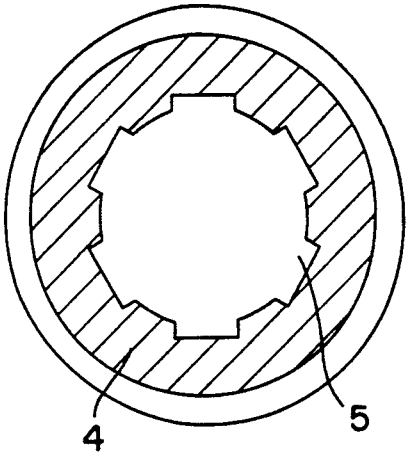
FIG. 4 is a cross-sectional view of a bobbin forming part of the inventive combination, taken on the line 4—4 of FIG. 3.

According to the invention, and as shown more particularly by way of example in FIGS. 1 and 2 of the accompanying drawing, the drive device for bobbins of a bank of spindles for long and short fibers is provided with a spindle 1 having at its upper free end elastically deformable drive means 2 coacting shape-matingly with a corresponding provision in the upper internal portion of the bobbin.

The elastically deformable drive means 2 is preferably constituted by a cylindrical base 2*a* having spaced apart spring leaves 3 in the shape of a tulip, which is to say that each leaf 3 extends upwardly and radially outwardly from base 2*a* and terminates in an incurved free end, said leaves 3 being disposed at regular intervals about the upper end perimeter of the spindle 1 and extending beyond the diameter of the cylindrical base 2*a*. Spring leaves 3 are spaced apart by slots 3*a* which, as seen in FIG. 1, progressively widen from base 2*a* to the free ends of leaves 3 and that extend downwardly for most of the length of base 2*a* in slits 3*b* of a uniform width substantially less than any width of slots 3*a*. A generally conventional hollow bobbin 4 is received on spindle 1.

The arrangement of the upper internal part of the otherwise conventional bobbin preferably consists in recesses 5 which can be notches of a shape corresponding to that of the leaves 3 and extending at corresponding regular intervals, or even by channel ways extending over all the internal portion of the bobbins.

In the case in which the recesses 5 are not exactly opposite the leaves 3 of the means 2, said leaves 3 bend elastically in the direction of the central axis and ensure a friction drive of the bobbin. This drive continues as long as the bobbin is not overwound, the bobbin turning, in this latter case, relative to the leaves 3 until the latter are positioned in the corresponding recesses 5. Such a relative movement between the bobbin and the spindle 1 does not in fact take place except over a fraction of a turn, the drive then becoming positive with no chance of interruption.

Because of the large number of leaves 3 coacting with a corresponding number of recesses 5, the drive device according to the invention permits fully emplacing the bobbin on the spindle 1 of a bank of spindles no matter what the angular position of said bobbin relative to said spindle 1.

The drive taking place by coaction between the leaves 3 of the means 2 of the spindle 1 and the recesses 5 of the bobbin, the device according to the invention imposes no axial pressure on said bobbin, thereby avoiding the tendency of this latter to rise.

Moreover, it is unnecessary that the robot for emplacing the bobbins effectuate operations for detecting the engagement position, which avoids the use of complicated and troublesome robots.

Finally, the leaves of the spring act simultaneously so as to annul any radial play of the bobbin on the spindle 1, thereby avoiding any possibility of vibrations.

Thanks to the invention, it is possible to provide a drive device for bobbins permitting perfect centering and drive of these latter, as well as their emplacement and their automatic removal.

Of course, the invention is not limited to the embodiment described and shown in the accompanying drawing. Modifications remain possible, particularly as to the construction of the various elements or by a substitution of technical equivalents, without thereby departing from the scope of protection of the invention.

What is claimed is:

1. The combination of a rotatable spindle and a bobbin receivable on the spindle for winding fibers on the bobbin, the spindle having an upper free end, and on said upper free end an elastically deformable drive means for the bobbin, said drive means comprising a cylindrical base secured to the spindle and from which extends upwardly a circular array of spaced resilient spring leaves, the bobbin being hollow and having on its interior a correspondingly spaced series of recesses that receive the spring leaves, whereby rotation of the spindle is transmitted to the bobbin via said spring leaves and recesses, said spring leaves extending upwardly and radially outwardly from said base and terminating in incurved free ends, said spring leaves being separated by slots that progressively widen from said base to said free ends and that extend downwardly for most of the length of said base in slits of a uniform width substantially less than any width of said slots.

* * * * *